US011412870B2

(12) United States Patent
Gonzalez Diaz

(10) Patent No.: US 11,412,870 B2
(45) Date of Patent: Aug. 16, 2022

(54) ERGONOMIC AND ORTHOPAEDIC PILLOW FOR AVOIDING FACE WRINKLES DURING SLEEP

(71) Applicant: Laura Fernanda Aguilar Gonzalez, Puebla (MX)

(72) Inventor: Laura Olimpia Gonzalez Diaz, Puebla (MX)

(73) Assignee: Laura Fernanda Aguilar Gonzalez, Puebla (MX)

( * ) Notice: Subject to any disclaimer, the term of this patent is extended or adjusted under 35 U.S.C. 154(b) by 25 days.

(21) Appl. No.: 16/770,716

(22) PCT Filed: Jun. 21, 2018

(86) PCT No.: PCT/MX2018/000055

§ 371 (c)(1),
(2) Date: Jun. 8, 2020

(87) PCT Pub. No.: WO2019/112412

PCT Pub. Date: Jun. 13, 2019

(65) Prior Publication Data

US 2021/0161318 A1 Jun. 3, 2021

(30) Foreign Application Priority Data

Dec. 6, 2017 (MX) ..... MX/a/2017/015864

(51) Int. Cl.
*A47G 9/10* (2006.01)

(52) U.S. Cl.
CPC ..... *A47G 9/10* (2013.01); *A47G 2009/1018* (2013.01)

(58) Field of Classification Search
CPC ..... A47G 9/10; A47G 2009/1018
See application file for complete search history.

(56) References Cited

U.S. PATENT DOCUMENTS 2,295,906 A * 9/1942 Lacour ..... A47G 9/10 5/636
3,667,074 A * 6/1972 Emery ..... A47G 9/109 5/636

(Continued)

FOREIGN PATENT DOCUMENTS

CN 203483199 3/2014
EP 2201921 6/2010

(Continued)

*Primary Examiner* — Eric J Kurilla
(74) *Attorney, Agent, or Firm* — Defillo & Associates, Inc.; Evelyn A. Defillo

(57) ABSTRACT

An ergonomic and orthopedic pillow for avoiding face wrinkles during sleep including a first rest body where the user rests his head; a second rest body of a density greater than that of the first rest body, a filling portion inside the second rest body; the first and second rest bodies are defined in their upper part by a portion of generally rectangular shape, which in the lower part of each of its ends houses a pair of face receiving cavities in which the cavities of face reception have a half-heart shape, more specifically they are provided with a semicircular portion in their upper part from which in a tangential way a flat section with an opening angle of at least 45° with respect to a plane emerges perpendicular to the upper part of the first resting body where the flat section, at its termination, has a rounding on the periphery of the cavity.

9 Claims, 7 Drawing Sheets

(56) References Cited

U.S. PATENT DOCUMENTS

| | | | | | |
|---|---|---|---|---|---|
| D308,787 | S | * | 6/1990 | Youngblood | 5/636 |
| 5,226,188 | A | | 7/1993 | Liou | |
| D388,648 | S | * | 1/1998 | Bates | 5/636 |
| D410,810 | S | * | 6/1999 | Lozier | D6/601 |
| 6,003,177 | A | * | 12/1999 | Ferris | A61F 5/01 5/636 |
| D434,936 | S | * | 12/2000 | May | D6/601 |
| 6,594,838 | B1 | * | 7/2003 | Hollander | A47G 9/10 5/490 |
| 6,913,019 | B2 | * | 7/2005 | Johns | A47G 9/10 128/845 |
| 7,165,279 | B1 | * | 1/2007 | Georgescu | A47G 9/10 5/490 |
| D541,096 | S | * | 4/2007 | Georgescu | D6/601 |
| D576,438 | S | * | 9/2008 | Peart | D6/601 |
| D690,535 | S | * | 10/2013 | Huang | D6/601 |
| 8,707,485 | B1 | | 4/2014 | Conley | |
| 8,887,332 | B2 | | 11/2014 | Alletto | |
| 8,931,127 | B1 | * | 1/2015 | Moses | A47C 27/15 5/652 |
| 9,027,185 | B2 | * | 5/2015 | Garcia | B60N 2/882 5/636 |
| 9,138,084 | B1 | * | 9/2015 | Namolovan | A47G 9/007 |
| D760,512 | S | * | 7/2016 | Atawane | D6/601 |
| D818,289 | S | * | 5/2018 | Facco | D6/601 |
| D835,222 | S | * | 12/2018 | Kim | D21/804 |
| D837,569 | S | * | 1/2019 | Barcohana | D6/601 |
| D837,570 | S | * | 1/2019 | Barcohana | D6/601 |
| 10,362,888 | B1 | * | 7/2019 | Barcohana | A61H 1/0296 |
| 10,441,487 | B1 | * | 10/2019 | Jerome-Miller | A47G 9/1054 |
| D871,796 | S | * | 1/2020 | Mi | D6/601 |
| D899,816 | S | * | 10/2020 | Deetsch | D6/601 |
| 2003/0217412 | A1 | * | 11/2003 | Johns | A47G 9/10 5/636 |
| 2008/0134439 | A1 | | 6/2008 | Ricalde | |
| 2010/0078033 | A1 | * | 4/2010 | Aikman | A61G 7/065 128/845 |
| 2013/0098364 | A1 | * | 4/2013 | Davis | A61G 7/072 128/206.21 |
| 2015/0047646 | A1 | | 2/2015 | Marinkovic | |
| 2015/0096124 | A1 | | 4/2015 | Yu | |

FOREIGN PATENT DOCUMENTS

| | | |
|---|---|---|
| MX | 2016000689 | 7/2017 |
| WO | WO2010075294 | 7/2010 |
| WO | WO2013032489 | 3/2013 |
| WO | WO2013116512 | 8/2013 |
| WO | WO2014066535 | 5/2014 |
| WO | WO2016003259 | 1/2016 |

* cited by examiner

ERGONOMIC AND ORTHOPAEDIC PILLOW FOR AVOIDING FACE WRINKLES DURING SLEEP

CROSS REFERENCE TO RELATED APPLICATION

This application is a national stage entry of PCT/MX2018/000055 filed Jun. 21, 2018, under the International Convention claiming priority over Mexican Patent Application No. MX/a/2017/015864 filed Dec. 6, 2017.

TECHNICAL FIELD

The present invention belongs to the technical field of the current necessities of life, specifically to the field of articles for personal and/or domestic use, more specifically to pillows with a certain configuration and even more specifically, the present invention makes Reference to an ergonomic and orthopedic pillow specially designed to avoid face wrinkles during rest.

BACKGROUND

Human beings spend about a third of their lives sleeping. The standard pillow that most people use during sleep is a rectangular pillow. Such a pillow provides insufficient sleep support for the user. The support provided is generally patchy and can lead to sleep disturbances, severe discomfort, and lack of relief from pre-existing conditions such as sciatica, low back pain, hip flexions, pelvic distortion, neck pain, breathing problems, and shoulder dysfunction. A person sleeping on their stomach with a standard rectangular pillow will often experience neck pain, which is not only a source of discomfort, but can also cause the person to lose the sleeping position on the stomach.

The pillow is an element on which the head rests preferably in the time interval in which a user is asleep, which is placed on a mattress commonly on top of the bed and is dressed to match it and Its main objectives are to keep the spine straight by filling the concavity of the neck to relax the nape of the neck, avoid muscular tension, reduce the stress accumulated during the day and help to achieve a restful and comfortable rest. A conventional pillow can be generally composed of three elements: a soft inner material that deforms with the weight of the limb that is placed on it; a stitched inner cover, which can be cotton or fiber, as well as an outer cover that can have a zipper so that it can be removed and washed.

Ideally, a pillow should keep the user's head and ears on the shoulders without much neck rotation and further configured so that when the user is lying on their side, the shoulder is slightly behind or in front of the chest wall and at the same while keeping the user's head and ears on the shoulders without too much neck rotation. For this reason, various designs have been proposed that seek to solve the problems of conventional pillows. One of these is located in U.S. Pat. No. 8,707,485 (B1) where a therapeutic pillow is provided that allows adequate support of the spine and neck by supporting an adequate range of cervical lordosis, while providing greater comfort. For the user. The pillow includes the combination of a firmer inner core and a second outer layer. The inner core area includes a central recessed area for the head and a curved neck area for spinal support, while the second outer layer provides comfort to the sleeper or user. The outer shell is padded with options including down/fill or down fill. The inner core insert of the pillow is made of polyethylene fiber and filled to a firm level for support. The inner core insert has two shape options, one for the side sleepers and the other for the rear/side combination sleepers.

In the same sense, in the international application WO2014066535 (A2) reference is made to a support pillow that provides head and neck support to a user who supports it. The device employs a support pillow insert surrounded by a pillow cover that has flat top and bottom surfaces and a side wall that extends between them. A snap-in insert into the shell provides substantially flat support surfaces with a centrally located passageway providing relief to place the head on the pillow.

Adequate support and alignment of the spine is provided by a shoulder portion of the neck pillow that may be formed of a different material than the pillow or may vary with compression force using inserts.

Also found as part of the state of the art is the utility model CN203483199 (U) where a multifunctional pillow is described comprising a pillow body and a filler that fits in the pillow body, where the pillow body is consisting of a first pillow body and a second pillow body with a common connecting part. Through the connecting part, a mutual accommodation can be made between the prime r pillow body and the second pillow body where the multifunctional pillow provided by the utility model is small in size and has dual functions. Mutual conversion between pillows with different shapes is performed. Not only can the multifunctional pillow be used as a U-shaped pillow, but the multifunctional pillow can also be used as a square or cylindrical pillow. Also, the conversion between the forms is convenient and two functions are performed. Not only the product material is saved, but also the functionality of the pillow is effectively improved, and in addition, the interest is enhanced. When the pillow is not used, the multifunctional pillow can be hung on the wall or other place through a hook that is arranged in a bra. Great flexibility and comfort of use and transport are realized, in the same way in the international application WO2013116512 (A1) reference is made of a universal pillow for seating on a base surface that includes an upper surface that has a negative parabolic shape or a convex shape with respect to the base surface and a bottom surface that has a concave shape relative to the base surface The pillow includes up to five zones, with a central zone designed for the side sleepers, the two adjacent zones are designed to the rear sleepers, and two adjacent exterior areas designed for those sleeping on their stomachs. The pillow can have different sections and parts to vary the feel of it.

In U.S. Pat. No. 8,887,332 (B2) a pillow is provided that includes a cover having opposite first and second panels. A gusset delimits the perimeter, and joins, the first and second panels. The reinforcement is formed by an open cell construction. The compatible filler material is arranged within the cover. Advantageously, with the present invention, a pillow is provided that allows lateral ventilation between opposing panels. This allows for a cooling effect while the user is resting or sleeping.

Another document that generally reveals the state of the art is the one located in the US patent application US2015047646 (A1) where that invention provides devices for the support and correction of the neck, for example, pillows, headrests or cushions, designed to be placed under the head and neck of a person lying supine or lying on their side. Such devices are useful for maintaining or improving the curvature and/or alignment of the cervical and/or thoracic spine and for reducing pain associated with ailments of the neck or cervical vertebrae. Methods are also provided to improve the alignment of the cervical spine and to treat or improve ailments of the neck or cervical vertebrae.

However, these pillows do not prevent skin contact with the entire surface of the skin, since the area where the face rests sinks, so that the face inevitably touches the surface to a large extent, causing that superficial wrinkles originate in the face; Furthermore, if a person wishes to use cosmetic products for skin care, they are scattered on the pillows, which has the disadvantage that they do not perform the function for which they are designed. According to studies, the face supported by a common pillow during a sleep period of more than two hours wrinkles and the expression lines deepen and if this is done daily, damage to the skin will lead to the appearance of new expression lines and deeper wrinkles added to this, with the use of common pillows, when using medical or cosmetic products, such as: creams, ointments, lotions, etc., as they do not have the proper ergonomic shape to avoid contact of the face in the areas mentioned above, these products remain on the surface of the pillow, canceling its effectiveness.

Although sleep lines are unavoidable, there are measures that delay their appearance, using a pillow with composition and firm fabric to avoid wrinkling with movements when sleeping. If you sink your head into the pillow and sleep like this overnight, this causes prolonged tension on your skin that can lead to tension or compression perpendicular to that of your facial muscles.

In order not to aggravate the problem that pillows can harm the good health of facial skin, several strategies arise; the cheapest of them is sleeping on your back, this is unlikely since we tend to change posture several times during sleep; Another option is to sleep on a pillow specially designed to avoid the folds that are formed by sleeping on smooth pillows.

It is usual to get up in the morning and find a wrinkled face after spending the night on the folds of a common pillow.

According to specialists, expression lines are unavoidable, but they can be delayed or attenuated by using a firm pillow to avoid marks on the face as well as being accompanied by a soft, smooth and firm fabric that does not wrinkle with movements during the dream. In addition to this, make use of anti-wrinkle products such as sunscreen, moisturizers and regenerators of the skin and with the use of a pillow designed especially for this purpose since it prevents the skin from touching the surface and prolongs the effect of these products, the benefits of this pillow you will be noticed waking up with a skin without marks.

According to studies of the skin, it ages naturally because from the age of 26 the production of collagen and elastin decreases according to scientists, this gives rise to the appearance of so-called "crow's feet" in the facial area, being the most notorious signs of aging, which we try to avoid since these areas of the face are our main concern, so this invention focuses mainly on those areas so that when sleeping the person contributes to decrease or delay these expression lines, using a pillow specially designed for this purpose.

There are other pillows on the market that help facial skin not to be marked with wrinkles, using different shapes or different materials such as "memory foam", some flatly try to avoid wrinkles by using only the nape support to Sleeping on your back or using very soft covers to avoid expression lines, these pillows are often ineffective for that purpose. Here are some examples of pillows already on the market.

The memory foam anti-wrinkle pillow is made from a fiber called Memory Foam with a special design, but due to the material it is made of, it does not provide adequate firmness and the face ends up sunk in said pillow, canceling out its anti-wrinkle effects.

The pillow called "Juvetex" promises to reduce expression lines and conserve the collagen of the face by using covers with a percentage of copper oxide in the fabric, which prevents the cover from wrinkling and marking the face.

Another pillow called "Dream Skin" also bets on the fabric cover with copper oxide in the composition of the fabric, promising the same effect as the so-called "Juvetex".

Although the other known pillows are intended to avoid wrinkles, either due to the material they are made with, such as cloth with copper or silk, there are others such as the so-called "Restform" that has a slightly more suitable shape for the purpose of avoiding that the face rests on the smooth surface of a common pillow, this is achieved by the design of the pillow that has a channel in its middle part to support only the upper and lower parts of the face, it does not have an adequate slope for the flow of blood from the head to the rest of the body, and its fixed shape on the edges does not allow adequate support of the chin as in my aforementioned invention where the person decides the most appropriate support by means of the movable arm.

The other pillow on the market is called "Save my Face" which have a slightly more consistent shape to avoid contact of the face in the ocular part and the nasogenian area, which is the area most susceptible to the formation of expression lines; This pillow has two free spaces on both sides to prevent the face from touching its surface but it does not have an adequate height so that the areas that are compromised are in an adequate space to avoid the formation of wrinkles, since due to its shape the face inevitably slides into the same cavity, which is uncomfortable and the person ends up sleeping on the entire surface of the pillow, here it is worth mentioning that the head needs adequate support points, which only my present invention grants.

One of the documents closest to the present invention is the international application WO 2016003259 (A1), which describes a wrinkle facial protection pillow, applicable to sleep in any position without crushing and deforming the face. It is made of a tubular piece, padded body made of padded and soft materials such as: polyurethane foam, memory form, gel, or any material with similar characteristics, with front and side cutouts that free the face and ears from contact. It has a cutout that makes it adjustable from the top through the contact fabric, and at the bottom through the piece and contact fabric. The padded body is attached to a frame consisting of a plastic, metal, or any rigid material. The frame consists of a ring at the top with lateral extensions that give elevation when lying on its side and a ring at the bottom rear forming a semicircle with a lift in the front middle part placed diagonally. The support between the padded body and the frame is provided by a clamping mechanism constructed of elastic material, providing cushioning when the user's head is suspended in the air.

Likewise, the Mexican application MX 2016000689 provides an orthopedic and face and skull protection pillow, in areas of injuries such as surgery or accidents, or other causes that require contact isolation, in any area of the face and skull. This pillow is formed by a padded cap, where the user inserts his head, and which has the virtue of providing different heights, while rotating on the axis of his own body when lying down, achieving an optimal posture when sleeping in any position; so that the back, neck and head will always be aligned; thus eliminating muscle strains and torticollis; This is achieved thanks to its design made up of different thicknesses on its walls. This pillow protects from contact injuries, the areas of surgery or accident on the face and skull or other causes that require contact isolation, in any area of the skull or face of the user.

However, none of the teachings reported in the state of the art has disclosed or suggested a pillow that prevents wrinkles during sleep, which in turn allows cosmetic products to be applied to the face during rest and which is also ergonomic and orthopedic, giving the user comfort and health.

SUMMARY OF THE INVENTION

It is therefore that the object of the present invention is to provide a pillow that provides greater taking advantage of the hours of rest, avoiding deep wrinkles that are marked on the skin around the eyes and mouth, potentiating the action of creams and treatments aesthetic and medical; in addition, to help the skin to heal properly when a user undergoes surgery on the face.

The solution offered by the proposal and main object of protection refers to an ergonomic and orthopedic pillow for avoiding face wrinkles during sleep, which purchases a first rest body where the user rests his head; a second rest body of a density greater than that of the first rest body, a filling portion inside the second rest body; where: said first and second rest bodies are defined in their upper part by a portion of generally rectangular shape, which in the lower part of each of its ends houses a pair of face receiving cavities in which said cavities of face reception have a half-heart shape, more specifically they are provided with a semicircular portion in their upper part from which in a tangential way a flat section with an opening angle of at least 45° with respect to a plane emerges perpendicular to the upper part of the first resting body where the flat section, at its termination, preferably has a rounding on the periphery of the cavity; In its lower part it has an arch placed in order that said arch provides the space for the lower part of the neck and upper back as well as the user's shoulders; at the intersection of the terminals of the ends of the arc and the flat section there is an adjustment extension that, from the end opposite the rounding where it interconnects with the middle zone, said adjustment extension has at least 20° of rotation with respect to a plane perpendicular to the upper part to accommodate the adjustment extension to the lower part of the user's face.

DESCRIPTION OF THE INVENTION

Figure 1:
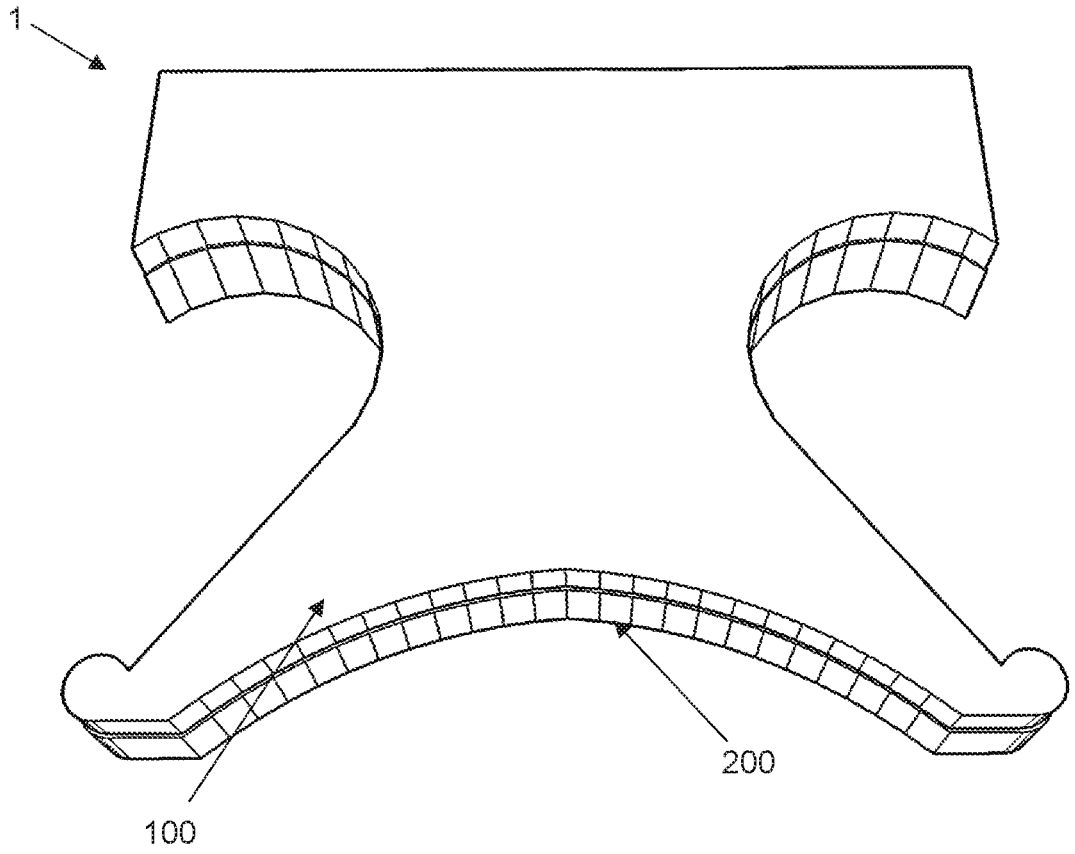
FIG. 1 shows an isometric view of the ergonomic and orthopedic pillow for avoiding face wrinkles during sleep.
Figure 2:
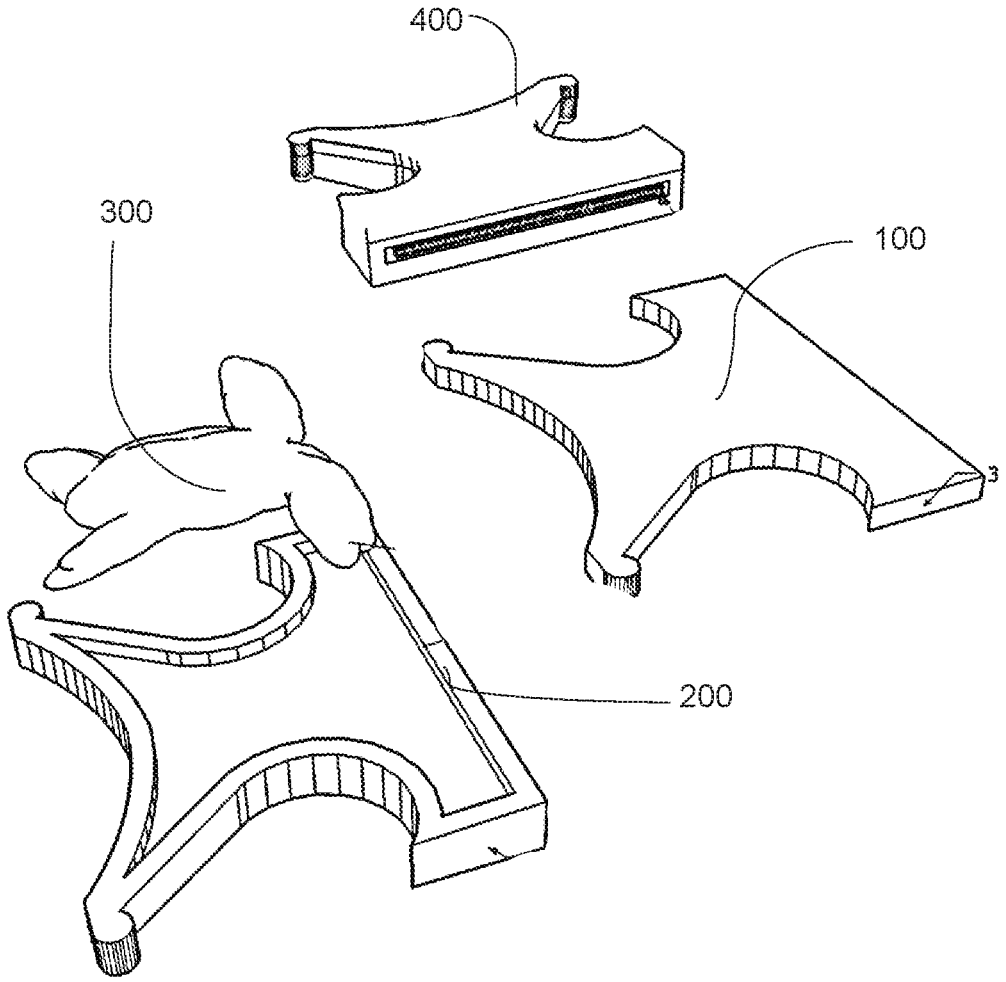
FIG. 2 shows an exploded view of the ergonomic and orthopedic pillow for avoiding face wrinkles during sleep.
Figure 3:
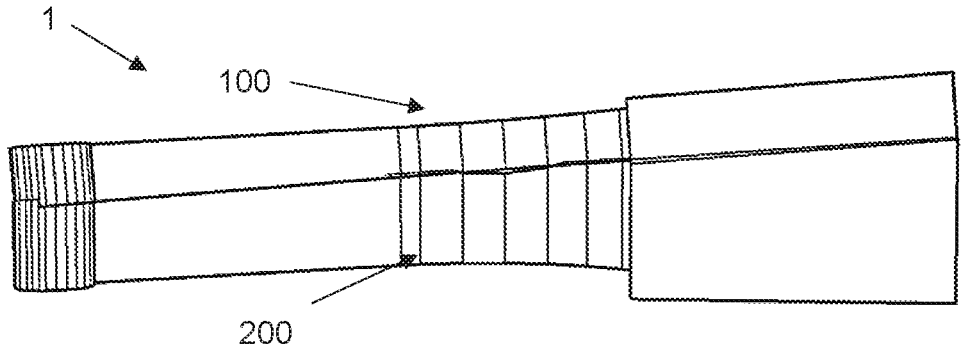
FIG. 3 shows a side view of the ergonomic and orthopedic pillow for avoiding face wrinkles during sleep.
Figure 4:
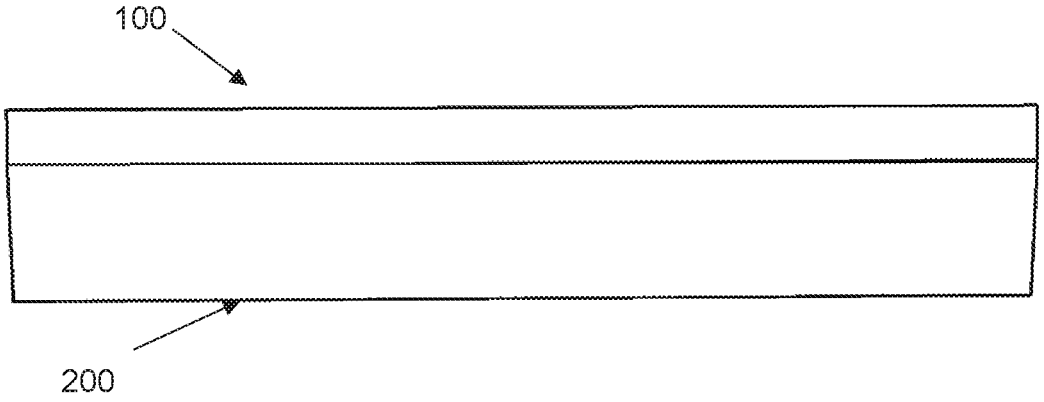
FIG. 4 shows a top view of the ergonomic and orthopedic pillow for avoiding face wrinkles during sleep.
Figure 5:
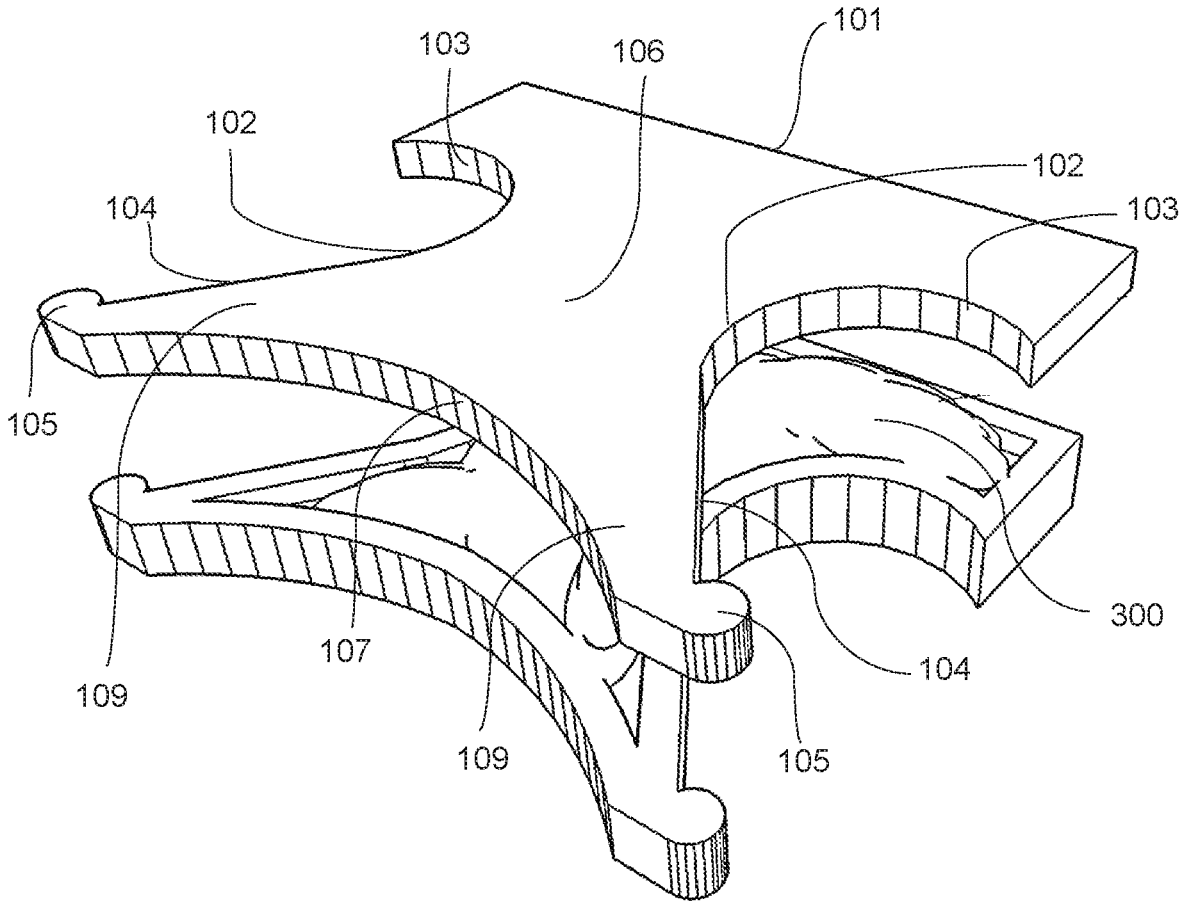
FIG. 5 shows an exploded isometric view of the ergonomic and orthopedic pillow for avoiding face wrinkles during sleep.
Figure 6:
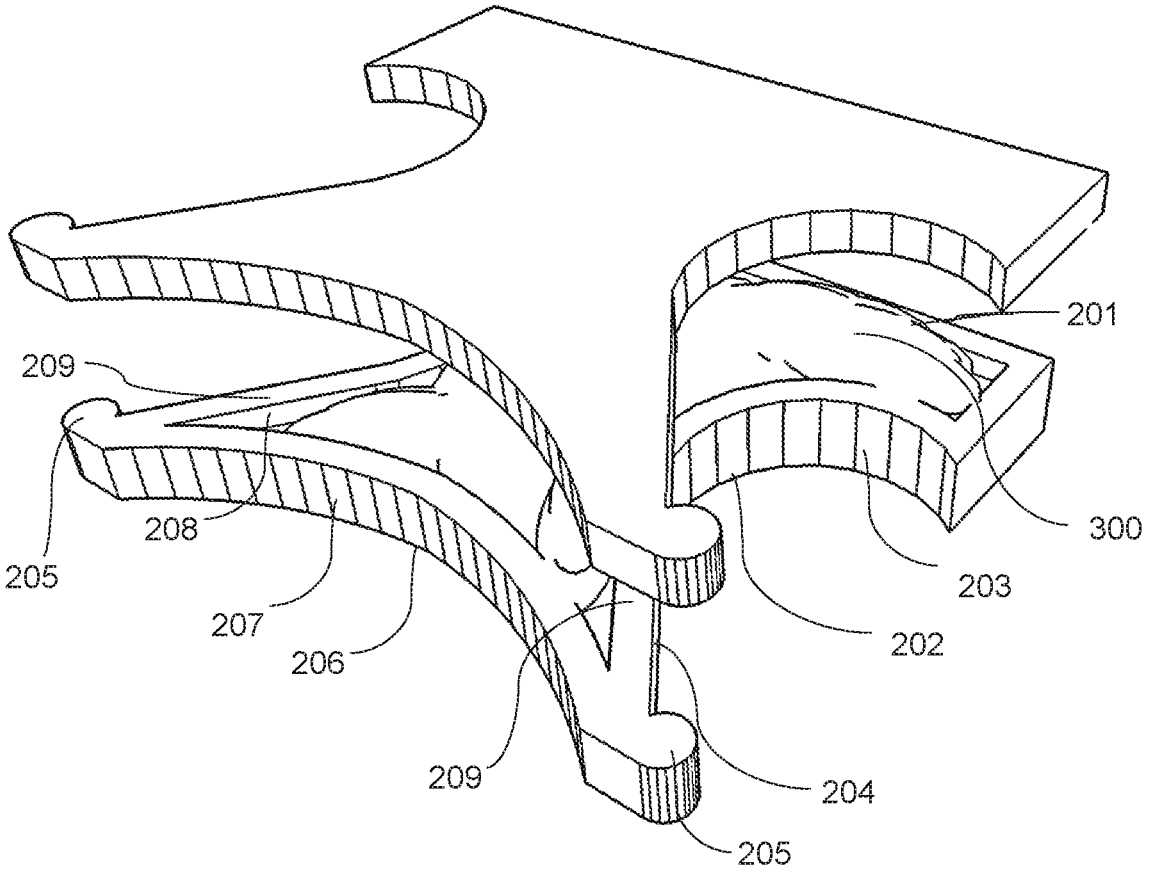
FIG. 6 shows an exploded isometric view of the ergonomic and orthopedic pillow for avoiding face wrinkles during sleep.
Figure 7:
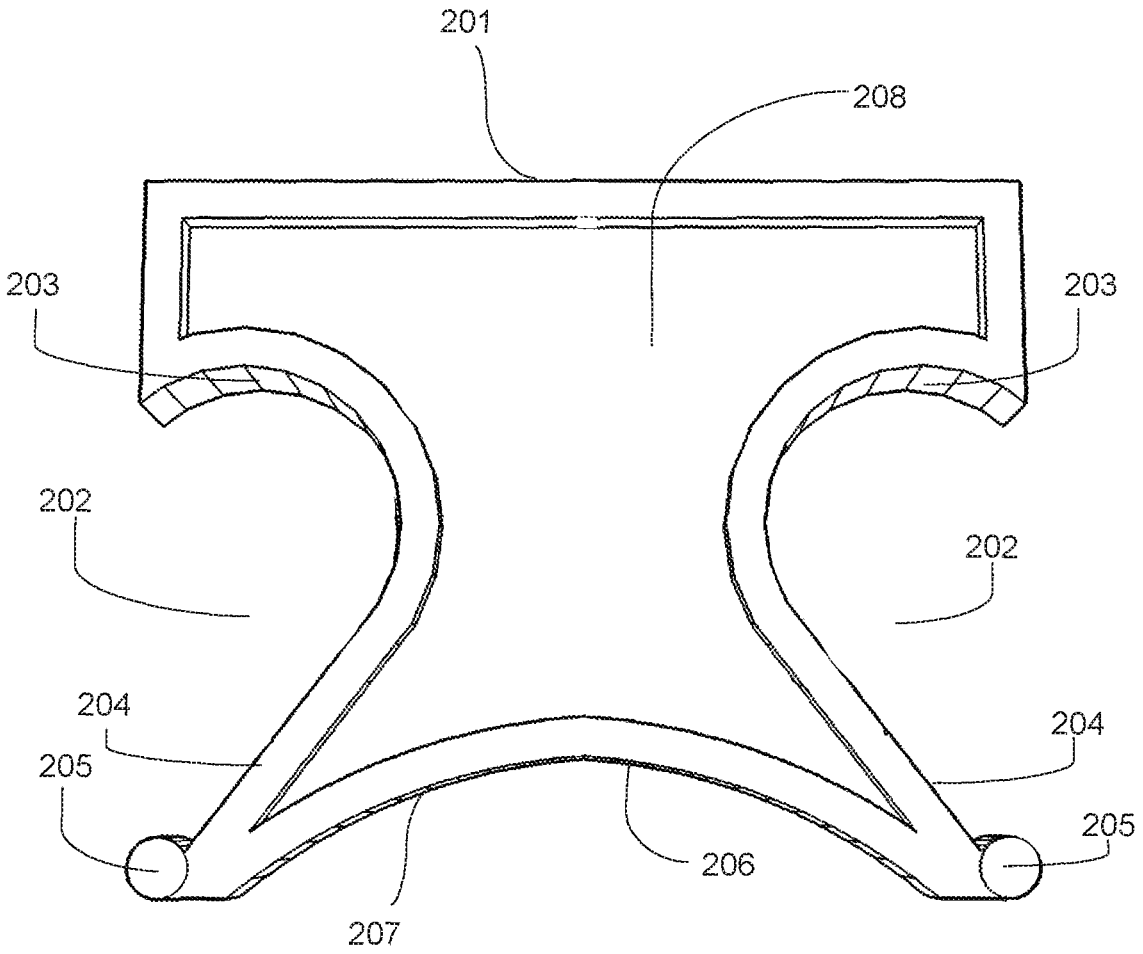
FIG. 7 shows a front top view of the ergonomic and orthopedic pillow for avoiding face wrinkles during sleep.
Figure 8:
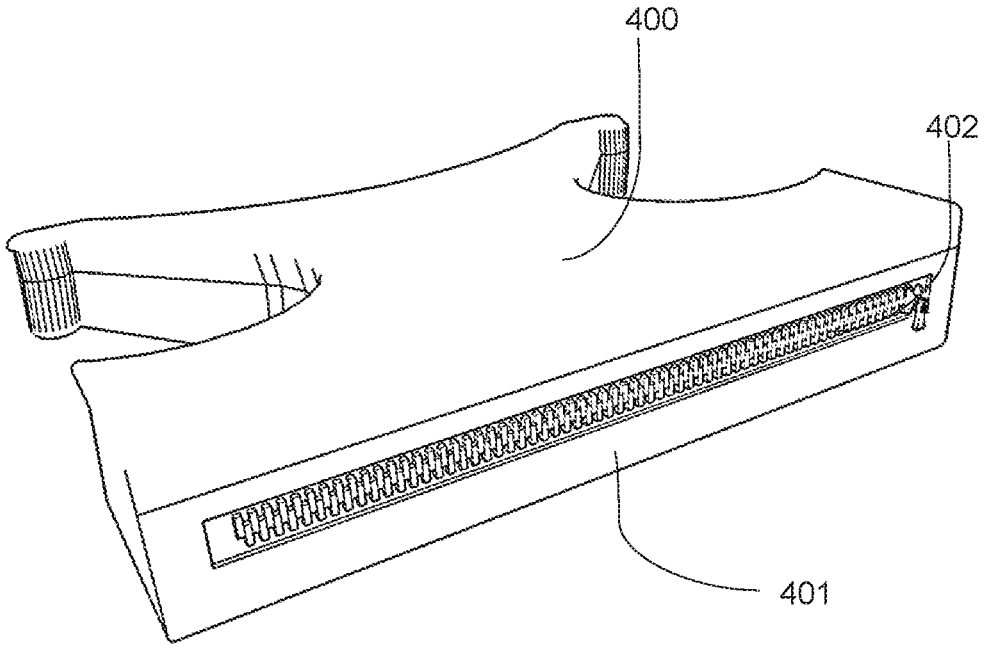
FIG. 8 shows an isometric top view of ergonomic and orthopedic pillow for avoiding face wrinkles during sleep.

The present invention refers to an ergonomic and orthopedic pillow (1) for avoiding face wrinkles during sleep, which is composed of a series of elements that together provide a plurality of advantages to the user, such as reducing skin aging, as well as providing a suitable means of sleeping laterally as it allows a perfect fit of the head in it, it also favors the position of sleeping on the back since it adapts perfectly to the shoulders and back of a user.

The present invention, which refers to an ergonomic and orthopedic pillow for avoiding face wrinkles during sleep, is generally integrated with a first rest body (100), which is where the user places his head in an upright or lateral position; a second rest body (200) of a density greater than that of the first rest body (100), a filling portion (300) inside the second rest body (200), as well as a cover (400) that wraps the assembly of the first rest body (100), the second rest body (200) and the filling portion (300).

The first rest body (100) has a preferred thickness of at least ten centimeters and is composed of a polymeric material with a density of at least 10 kg/m3, which gives it a soft and firm composition; It is defined in its upper part (101) by a generally rectangular portion, which in the lower part of each of its ends has a pair of face receiving cavities (102) in which said face receiving cavities have a half-heart shape, more specifically they are provided with a semicircular portion (103) in their upper part from which in a tangential way a flat section (104) emerges with an opening angle of at least 45° with respect to a plane perpendicular to the upper part (101) of the first rest body (100) where the flat section (104), at its termination, preferably has a rounding (105), on the periphery of the receiving cavities (102) the user poses the front of the temporal zone, the lacrimal, nasal, upper jaw, lower jaw and chin of the head, with the user's face, on the side they wish to lay, either left or right, this is free from contact with any surface of the pillow or mattress, allowing the deep wrinkles that are marked on the skin around the eyes and mouth derived from contact with surfaces during periods in which the user sleeps, to avoid potential and allow the correct use and implementation of creams and medical or aesthetic treatments on the skin; in addition to helping the skin to heal properly when the user, for example, undergoes some previous surgery on the face; in the middle section (106) between both face receiving cavities (102), the user places the back of the head in the assumption that his sleeping position is on his back, the middle section (106) having his part The lower part has an arch (107) placed so that said arch provides the space for the lower part of the neck and upper back as well as the user's shoulders. At the intersection of the terminals of the ends of the arch (107) and of the flat section (104) there is an adjustment extension (109) that from the opposite end to the rounding (105) where it interconnects with the middle section (106), said adjustment extension (106) has at least 20° of rotation with respect to a plane perpendicular to the upper part (101) of the first rest body (100) for accommodating the adjustment extension (109) to the part lowers the user's face.

The second rest body (200) has a thickness of at least eight centimeters, it is made with a polymeric material of at least 14 kg/m3 that gives it a composition with less smoothness than the first rest body; It is located in the lower part of the first rest body (100) and is defined in its upper part (201) by a portion of generally rectangular shape as in the first rest body (100) and in the same way said upper part (201) at the bottom of each of its ends defines, a pair of face receiving cavities (202) in which said face receiving cavities have a half-heart shape and more specifically are provided from a semicircular portion (203) in its upper part from which in a tangential way a flat section (204) with an opening angle of at least 45° with respect to a plane perpendicular to the upper part (201) of the second rest body (100) where the flat section (204), at its termination preferably has a rounding (205), on the periphery of the cavity for receiving the cavities (202) the user poses the front of the area temporary, the tear zone, nasal, upper jaw, lower jaw and men tone of the head, having the user's face, on the side they wish to lay on, either left or right, is free from contact with any surface of the pillow or mattress, allowing the deep wrinkles that are marked on the skin to be avoided around the eyes and mouth derived from contact with surfaces during the periods in which the user sleeps, enhance and allow the correct use and implementation of creams and medical or aesthetic treatments on the skin; in addition to helping the skin to heal properly when the user, for example, undergoes some previous surgery on the face in the section defined in the middle zone (206) between both face receiving cavities (202), the user places the back of the head in the assumption that its sleeping position is on its back, since the middle zone (206) in its lower part has an arch (207) placed in order that said arch provides the space for the shoulders, the lower part of the neck and upper part of the user's back; in a zone proximal to the periphery of the second rest body (200) there is a partial recess (208) that in its perimeter retains the shape of the periphery of the second rest body (200) and inside said partial recess, the filler portion (300) is inserted, which may preferably be made of natural or soft synthetic materials, which in the case of natural ones may be feathers, cotton, among others, and in the case of synthetics such as "Delcron," which provides a wide degree of smoothness without losing firmness in the arrangement. At the intersection of the terminals of the ends of the arch (207) and of the flat section (204) it has an adjustment extension (209) that from the opposite end to the rounding (205) where it interconnects with the middle zone (206), said adjustment extension (206) has at least 20° of rotation with respect to a plane perpendicular to the upper part (201) of the first rest body (200) for accommodating the adjustment extension (209) to the lower part of the user's face. The cover (400) is a fabric portion that is configured so as to cover the integration of the first rest body (100) coupled to the second rest body (200) that houses the filling portion (300) inside and in its upper end (401) the cover (400) has a means of closing and opening (402) by means of which the user can have access to the pillow as well as being able to protect it to protect it from dust, moisture, among other agents that affect its composition.

The main advantage of ergonomic and orthopedic pillow (1) to avoid facial wrinkles during sleep, object of the present invention is that it does not leave marks on the skin, nor the so-called sleep wrinkles, in addition to its firmness favoring the development of a series of anti-aging properties for its comfort and anti-gravity qualities because it favors hydration derived from contact with an air current caused by the face reception cavities (202) and (102) as well as the elasticity of the skin, its design anatomical gives a perfect fit in the shoulders, neck and head which favors good posture during sleep and allows an ideal alignment between the spine and the head.

The proposal described in this specification avoids the contact that is exerted between the face and the medium where it rests during sleep. The design of its ends prevents pressure from being exerted on the skin, favoring its oxygenation; in addition, this pillow helps in delaying the appearance of wrinkles, as well as the attenuation of existing ones.

In addition to assisting in the prevention of the appearance of wrinkles, it improves the flow of the air current that enters through the nose of a user, allowing greater oxygenation of the body that results in the aid of the reduction of snoring, in the same sense minimizes pain and facilitates recovery after surgery. The user's skin is suspended in the air without making contact with the surface of the pillow in the same way, due to its design it allows the user to sleep on their right or left side without having to turn the pillow.

The present invention is anatomically designed to avoid wrinkles that form with the use of ordinary pillows; Furthermore, the present invention has the ergonomics necessary for the care of facial skin, to avoid the formation of new wrinkles or to attenuate existing ones, specifically in the facial area; It also minimizes this problem since, due to its design, the user's face is suspended in the air away from the folds of the fabric and due to its shape, it allows the face to fit without ending up with the face upside down on the mattress.

One more advantage is that thanks to its shape and design, it helps correct healing when there is a medical surgical intervention or it is This is achieved by avoiding contact of the intervened areas with a body outside the area during rest.

Still another advantage of the present invention is that during rest a greater use is made of the hours of sleep to help the user to reduce or reduce wrinkles on the face, resting on the pillow specially designed for this purpose, this is achieved by supporting only the temple, the middle part of the head and the chin in this anti-wrinkle pillow, leaving most of the eye area and the area of the nasogenians free, in an empty space shaped like a half heart located on both sides of the pillow, at the leaving this area free also helps us to potentiate the effect of beauty products such as creams and ointments, medical treatments etc., in addition, also; prevents the face from touching the surface of the pillow when we undergo any surgery or medical or aesthetic treatment, thus favoring the correct healing of the skin; therefore, the object of the present invention.

The half-heart shaped design located in the face receiving cavities (202) and (102) on each side of the pillow, allows the user to sleep comfortably on either side, both right and left, without the areas of greatest incidence wrinkles are compromised by the pressure of the head against the pillow surface, this is achieved by leaving the eye and nasogenians area free, because the support of the face is only given in specific points such as the temple, the ear and the chin; in addition, the person can accommodate the adjustment extensions (109) and (209), to achieve the desired support; furthermore, if the person wishes to sleep on his back, he can make use of the middle section (106) or (206) depending on the degree of softness that he wishes.

The selected preferred materials that make up the ergonomic and orthopedic pillow (1) to avoid facial wrinkles during rest, the reason for this invention, provide the firmness necessary to prevent the face from sinking and that it is marked; but not limited to, the first rest body (100) and the second rest body (200) are made of foam rubber of different densities, preferably density 10 and 14 kg/m3, respectively, which gives greater firmness; the filler portion (300) can be made of soft, fluffy materials with insulating properties, microbicides such as mixed/mixed with feathers, synthetic fibers such as Delcron, memory foam, latex, cotton, or combinations thereof, to provide ideal softness combined firmness with softness. The cover (400) can be of various materials such as: silk, linen, flannel, or some waterproof fabric or combinations thereof, considering materials that provide the ideal temperature according to the climate and user preferences, thus providing an affordable pillow with the desired comfort and features and can be washed to maintain hygiene.

Advantageously, the pillow has an ergonomic shape, to accommodate the face and distribute the weight well at the support points, either on the periphery of the face reception cavities (202) and (102) which are the temple, the forehead and chin; the half-heart shapes on both sides of this pillow (1) form the adjustment extensions (106) and (206) that can be adapted to the size of the face so that the user can obtain the support of the head.

The straight shape at the upper part (101) and (201) of the pillow (1) allows the correct slope towards the bottom and allows the vertebrae to align correctly.

Notwithstanding that the above description was made taking into account the preferred embodiments of the invention, it should be borne in mind by those skilled in the art that any modification of form and detail will be within the spirit and scope of the present invention. The terms in which this report has been written must always be taken in a broad and non-limiting sense. The materials, shape and description of the elements will be subject to variation as long as this does not imply an alteration of the essential characteristic of the model.

The invention claimed is:

1. A pillow to avoid face wrinkles during sleep, comprising:

a first rest body adapted to receive a head of a user, the first rest body having an upper part and a lower part;

a second rest body having a density greater than a density of the first rest body, the second rest body having an upper part and a lower part;

a filling portion located inside the second rest body;

wherein the upper part of said first and said second rest bodies has a section having a rectangular shape, wherein the first and the second rest bodies include a first and a second face receiving cavities located between the section having rectangular shape and the lower part; wherein each one of said face receiving cavities has a half-heart shape, the half-heart shape having a semicircular portion and a tangential flat section emerging from an end of the semicircular portion with an opening angle of at least 45° with respect to a plane perpendicular to the upper part of the first resting body, wherein each one of the flat sections include a termination having a rounding end on a periphery of the first and the second face receiving cavities;

wherein the lower part of each one of the first and the second resting bodies includes an arch, each arch having a first terminal and a second terminal;

wherein at an intersection of each one of the first and second terminals of each arch and the corresponding flat section, there is an adjustment extension that, from the end opposite to the rounding end where it interconnects with a middle part of each one of the first and the second rest bodies, said adjustment extension has at least 20° of rotation with respect to a plane perpendicular to the upper part of each one of the first and the second rest bodies.

2. The pillow for avoiding face wrinkles during sleep according to claim 1, wherein the pillow has a wraparound cover.

3. The pillow for avoiding face wrinkles during sleep according to claim 2, wherein the cover is a fabric portion that covers the integration of the first rest body coupled to the second rest body that in an interior section contains the filling portion and at an upper end has a closing and opening device.

4. The pillow for avoiding face wrinkles during sleep according to claim 1, wherein the first rest body has a thickness of at least ten centimeters.

5. The pillow for avoiding face wrinkles during sleep according to claim 1, wherein the first rest body is composed of a polymeric material having a density of at least 10 $kg/m^3$.

6. The pillow for avoiding face wrinkles during sleep according to claim 1, wherein the second rest body has a thickness of at least eight centimeters.

7. The pillow for avoiding face wrinkles during sleep according to claim 1, wherein the first rest body is composed of a polymeric material having a density of at least 14 $kg/m^3$.

8. The pillow for avoiding face wrinkles during sleep according to claim 1, wherein the filling portion is made from a material selected from the group consisting of soft materials, spongy materials with insulating properties, microbicides mixed with feathers, synthetic fibers, foam, memory foam, latex, cotton, or combinations thereof.

9. The pillow for avoiding face wrinkles during sleep according to claim 2, wherein the wraparound cover is made from a material selected from the group consisting of silk, linen, flannel, and waterproof fabric.

* * * * *